United States Patent [19]

Caffrey

[11] 4,332,102

[45] Jun. 1, 1982

[54] SUPERIOR PERFORMANCE YO-YO

[76] Inventor: Michael S. Caffrey, 1801 S. Kevin Dr., Tucson, Ariz. 85710

[21] Appl. No.: 201,160

[22] Filed: Oct. 27, 1980

[51] Int. Cl.[3] ..... A63H 27/12

[52] U.S. Cl. ..... 46/61

[58] Field of Search ..... 46/61, 60, 47, 228

[56] References Cited

U.S. PATENT DOCUMENTS

| | | | |
|---|---|---|---|
| 3,175,326 | 3/1965 | Isaacson | 46/61 |
| 3,256,635 | 6/1966 | Radovan | 46/61 |
| 3,263,361 | 8/1966 | Bowden | 46/61 |
| 3,444,644 | 5/1969 | Sayegh | 46/61 |
| 3,643,373 | 2/1972 | Russel | 46/61 |
| 3,936,974 | 2/1976 | House | 46/61 |
| 3,953,936 | 5/1976 | Ennis | 46/61 |
| 4,081,924 | 4/1978 | Fabricant | 46/61 |
| 4,130,962 | 12/1978 | Ennis | 46/61 |

*Primary Examiner*—Robert Peshock
*Assistant Examiner*—Mickey Yu
*Attorney, Agent, or Firm*—J. Michael McClanahan

[57] ABSTRACT

A superior yo-yo toy exhibiting characteristics of a lengthened spinning time for performing tricks while retaining characteristic of returning to the hand of the operator when desired; and automatic return to the operator when the yo-yo rotational rate has slowed to a predetermined rate. The yo-yo string is attached to a free-spinning bearing surrounding the axle, the bearing operably connected to a centrifugal actuated spring loaded clutch mechanism so that when the yo-yo rotational rate slows to a pre-determined rate, the clutch mechanism engages the bearing, coupling the free-spinning bearing to the yo-yo and causing the yo-yo to return to the operator.

12 Claims, 7 Drawing Figures

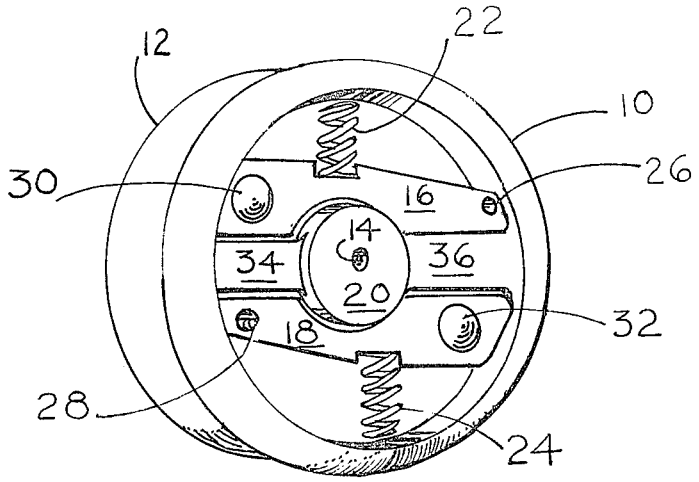
FIG. 1
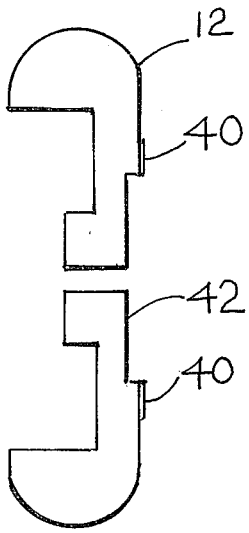
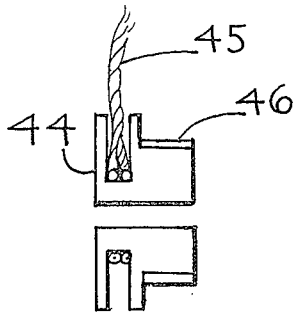
FIG. 4
FIG. 3
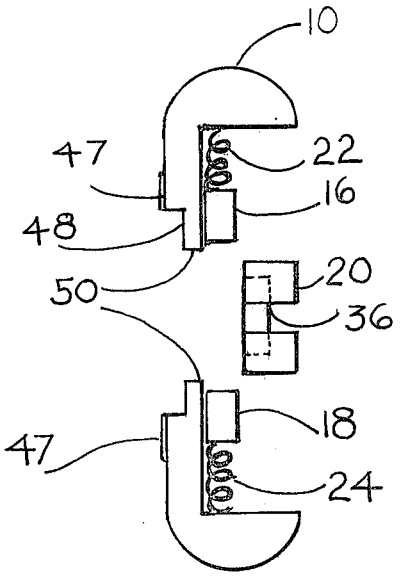
FIG. 5

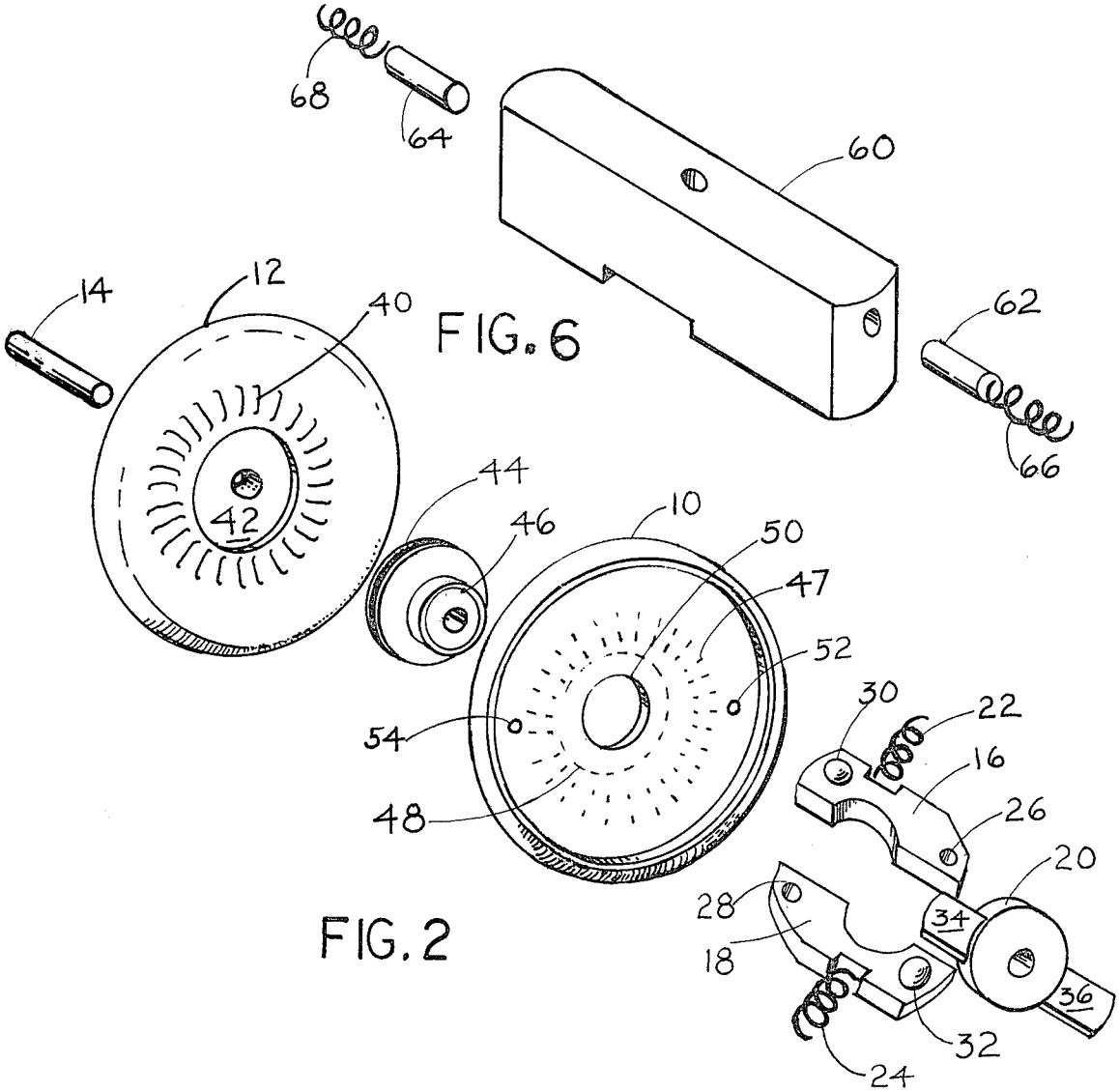
FIG. 6
FIG. 2
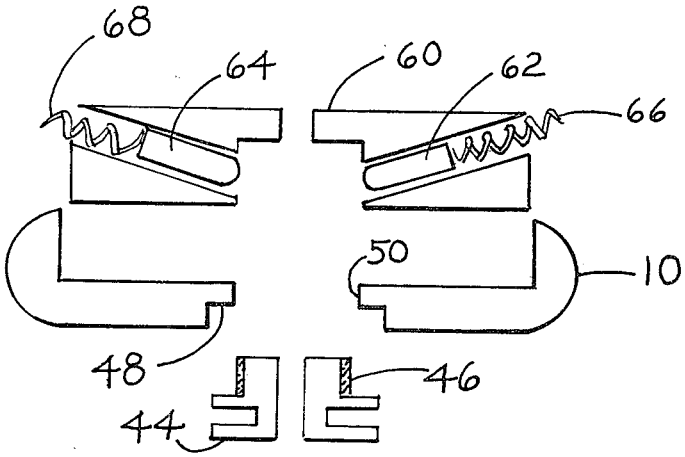
FIG. 7

SUPERIOR PERFORMANCE YO-YO

BACKGROUND OF THE INVENTION

Yo-yos have been a toy for children and adults for many years. The general shape of the yo-yo, consisting of two circular discs, attached at their center by a reduced diameter axle has been the general configuration by which they have been known. There has been improvements made to the basic configuration, largely decorative but also in some measures attempting to improve the performance. For example, Ennis in U.S. Pat. No. 4,130,962, disposes the weight of the yo-yo in the periphery of the disks of the toy. Here, Ennis provides the yo-yo with a flywheel effect by placing the weight of the yo-yo near its periphery. Ennis also describes cone-shaped protuberances with rounded ends situated circularily on the inside spaces of the disks proximate the central axle where the rounded tipped protuberances snare loose strands of the yo-yo string for wind-up.

Also, Russell, in U.S. Pat. No. 3,643,373, describes a yo-yo with specially designed disks such that appealing visual effects are obtained when the toy is spinning or in an inoperative position.

One shortcoming of the present state of the yo-yo art is that the,string of the yo-yo engages directly the central shaft and thereby incurs weakening abrasions when the yo-yo is placed into its tricks utilizing the yo-yo spinning at the end of the string. Consequently, it is common for the strings of yo-yos to break frequently and thus require replacement. Another problem with the present art is the forming of knots about the yo-yo central axle by the string doubling upon itself. This provides a major source of frustration for the beginning player.

In addition, it is a sought after effect to have a yo-yo which tends to spin in its free spinning mode longer than other yo-yos. In fact, contests are held in this regard. The spinning time determined in large part by two factors, the first being the rotational speed which can be imparted to the yo-yo when it unwinds on its string responding to the throwing action by the operator, and secondly, the friction generated by the free spinning yo-yo between the string and the yo-yo central axle at the end of the yo-yo string. Obviously, the strength of the string is a limiting factor as how hard the yo-yo may be thrown, and the gradual weakening of the string due to the abrasive friction tends to reduce the strength of the string.

Another difficulty with the present art yo-yos are that in attempting to throw the yo-yo into a free spinning configuration, the yo-yo has a tendency to bounce back when it reaches the end of the yo-yo string, gathering string as it goes and then continue to retract to the operator's hand. In addition, when an operator is performing tricks and the tricks are of the type where you have multiple strings between the faces of the spinning yo-yo, i.e., where the yo-yo string is doubled or tripled back upon itself between the yo-yo halves while the yo-yo continues to spin, premature retrieval is of greater likelihood because of the increased friction between the strings and the yo-yo resulting in the yo-yo catching the string and returning to the operator.

Thus, it is apparent there is a desire for an enhanced time of free spinning to perform yo-yo tricks and to better enjoy the toy.

SUMMARY OF THE INVENTION

The present invention comprises improvements to yo-yos by reducing the frictional drag between the yo-yo string end and its central axle, and in the method utilized by the inventor, also enhancement of string life. More specifically, the invention attaches the yo-yo string to a bearing-pulley located around the central shaft.

Placing a bearing between the yo-yo string and the central shaft will increase the spinning time of the yo-yo, however, the free spinning bearing destroys the control of the operator to retrieve the yo-yo either when desired, or near the end of the period of the rotation of the yo-yo. Applicant avoids these problems by an automatic means where the yo-yo is returned to the operator's hand as its rotational rate slows through means of centrifically operated clutches engaging the sides of the bearing-pulley and by the clutches engaging the bearing-pulley as the yo-yo is flicked during return command. The centrifugal acting clutches, in the preferred embodiment, are arms surrounding a portion of the bearing-pulley, spring loaded in the direction of the bearing-pulley, and having weights at the ends opposite the pivotal point so that as the yo-yo spins, the weights carry the arms away from the bearing-pulley by centrifugal force, and only when the rotational rate has slowed sufficiently or other forces are sufficient, the springs overcome the forces and the clutch arms pivot back to engage the bearing-pulley, lock it into rotational alignment with the sides of the pulley and thus climb the string to the operator's hand.

It is obvious that the yo-yo string life will be lengthened because the string no longer needs to be in direct contact with the abrasion causing yo-yo central axle.

Accordingly, it is an object of the present invention to provide a yo-yo toy where free spinning time is greatly increased.

Further, it is another object of the present invention to provide a means where the friction between the yo-yo central axle and the string is lessened by utilization of a bearing, however, retaining the ability to retract the yo-yo at will.

It is still a further object of the subject invention to provide a yo-yo which, in utilizing the bearing surface between the yo-yo string and yo-yo axle, also provides a means to automatically retract the yo-yo to the operator's hand before the yo-yo spins out completely.

It is still a further object of the subject invention to provide a yo-yo where the operator is more assured of the yo-yo going into a free spinning mode of operation.

BRIEF DESCRIPTION OF THE DRAWINGS

FIG. 1 is a perspective view of the subject long spinning yo-yo with the outside cover removed.

FIG. 2 is an exploded perspective view of the long spinning yo-yo shown in FIG. 1.

FIG. 3 is a cross-sectional view of the construction of one of the yo-yo halves.

FIG. 4 is a cross-sectional view of the bearing-pulley employed in the invention.

FIG. 5 is a cross-sectional view of the long spinning yo-yo second half including the clutch mechanism and hub.

FIG. 6 is a perspective view of an alternate embodiment housing a different construction of clutch mechanism.

FIG. 7 is a cross-sectional view of the alternate embodiment showing the clutch mechanism utilized in the long spinning yo-yo.

DETAILED DESCRIPTION OF THE PREFERRED EMBODIMENT

Referring now to FIG. 1, a perspective view of the inventive long spinning yo-yo is shown. In detail, the subject invention includes the standard rotating body segments, nominally disk shaped yo-yo halves 10 and 12 held in parallel plane configuration by a central shaft 14 (of which only the end is showing). Unique in the subject invention is the rotatable bearing-pulley (not shown in FIG. 1), and the clutch mechanism members, here upper clutch member 16 and lower clutch member 18, sometimes termed clutch securing members, residing on opposite sides of central hub 20. Urging the upper and the lower clutch members 16 and 18 towards the center of the yo-yo are compression springs 22 and 24 respectively. Both upper and lower clutch members 16 and 18 are pivotal about pins 26 and 28 respectively. At ends opposite pins 26 and 28 upon upper and lower clutch members 16 and 18 are weighted balls 30 and 32 respectively. These balls are placed into holes which have been formed in the clutch members.

Not shown in FIG. 1 is the friction surface against which the central inwardly rounded portion of the upper and lower clutch members 16 and 18 engage.

The clutch mechanism, comprising the upper and lower clutch members 16 and 18, their respective pins 26 and 28, weighted balls 30 and 32, as well as upper and lower compression springs 22 and 24 all reside interiorly to yo-yo half 10 by virtue of the recess which has been cut into the central thickness of yo-yo half 10 and is shown in relief form in FIG. 1. Central hub 20, which receives and holds one end of central shaft 14, is held in place by means of connective member 34 upon the left and 36 on the right. These members attach to opposite sides of central hub 20 and engage the wall formed by the circular recession in yo-yo half 10. Nominally connective members 36 and 34 are attached by an adhesive to yo-yo half 10, or if constructed of extruded plastic, are formed when the yo-yo half 10 is formed so that there are no breaks in the material. An exploded perspective view of the subject invention is shown in the following FIG. 2.

Referring now to FIG. 2, and beginning from left to right, central shaft 14 comprises an elongated shaft of a durable material, such as steel, but which may be a rigid plastic. Shaft 14 is held securely by both yo-yo halves 12 and 10, preferably by being a press fit through preformed holes in the halves. Continuing, left yo-yo half 12 is shown comprising the disk shaped body segment having a rounded circumference and flat inner annular surface. Proceeding from right to left on this piece, radiating spokes 40 are shown, nominally slightly raised elongated protrusions eminating from the flat parallel sides of yo-yo half 12. The spokes continue inwardly to a circular recession 42 formed in the flat circular inside surface of yo-yo half 12. The diameter and the depth of circular recession 42 are slightly larger than the diameter and the thickness of the flat circular side of the bearing-pulley 44 shown next in line. Bearing-pulley 44, which is better shown in FIG. 4, infra, comprises two flat thin circular disks attached to a central hub having a centrally located hole therethrough, the disks comprises the sides of the pulley portion of bearing-pulley 44. In appearance it looks, upon end view, much like the ordinary pulley with a formed annular groove available in a hardware store. Attached to the pulley and a part thereof is the friction surface 46 about which the upper and lower clutch members 16 and 18 engage. In the preferred embodiment, this friction surface is rubber, nominally by placing an annular rubber gasket upon the outer surface of the solid disk attached to the outside of one of the disks making up the pulley to make the friction surface 46. This bearing-pulley 44, to which is attached about the central hub of the pulley, is the string utilized in the yo-yo and in the preferred embodiment, is of one piece construction with the two parallel circular disks of the pulley adapted to receive the string wrapped in preferably a double strand around its central hub. Centrally located through the bearing-pulley 44 is the opening for central shaft 14, the hole or opening being of slightly larger diameter than shaft 14.

As it is intended that the bearing-pulley 44 should remain stationary and attached to the string while the yo-yo is rotating, the preferred embodiment constructs the bearing-pulley 44 of a graphite impregnated teflon for reduced friction between it and central shaft 14.

Continuing on, right yo-yo half 10 is next illustrated showing the similar circular body segment disk and having interiorly thereto the substantial circular portion removed and adapted to receive the clutch mechanism. On the side of the yo-yo opposite the circular area which has been removed, i.e., the inside of the yo-yo, is shown a dotted circle which represents the wall of a circular depression 48 formed to accomodate the right handed pulley disk of bearing-pulley 44. Internally to depression 48 is a circular opening 50 which permits the mass of the friction surface 46 to protrude through the wall which forms the interior of the yo-yo half 10. Shown rising radially away from the outside of circular depression 48 are radiating spokes 47, the counterpart of radiating spokes 40 upon yo-yo left half 12.

On opposite sides of the opening 50 are pin-holes 52 and 54 which accomodate the pins 26 and 28 respectively of the clutch mechanism.

It is intended that when the subject yo-yo is assembled, one looking into the region between the two yo-yo halves, i.e., the gap, would only see the central hub of bearing-pulley 44 since both sides of the pulley portion of bearing-pulley 44 are recessed into opposite sides of the yo-yo halves 12 and 10. The friction surface 46 thus protrudes through the opening 50 a substantial distance so that it may be engaged by the clutch mechanism next described.

Continuing on with the subject invention shown in FIG. 2, the clutch mechanism which engages bearing surface 46 of bearing-pulley 44 is next detailed. Pivot pins 26 and 28 pass through upper and lower clutch members 16 and 18 respectively and is press-fitted into pin-holes 52 and 54 respectively. Upper and lower clutch members 16 and 18 comprise leg shaped arms which are urged against frictional surface 46 which protrudes through opening 50 by means of compression springs 22 and 24. The travel of upper and lower clutch members 16 and 18 are stopped by frictional surface 46 resisting the half circle cut out portions and of upper and lower clutch members 16 and 18 respectively. For the instances when bearing-pulley 44 may not be in place in the pulley (this would only happen during times of assembly or dis-assembly) the upper and lower clutch members 16 and 18 then come to rest, at their ends opposite their pivot pins, upon the connective members 34 and 36 of central hub 20 later described. As previously mentioned, weighted balls 30 and 32 reside in openings formed in the upper and lower clutch members 16 and 18.

The next member of the inventive yo-yo is the central hub 20 which receives central shaft 14, the central hub 20 being held in place in the depression formed in yo-yo half 10 by its opposite connective members 34 and 36.

It is expected that shaft 14 will be press-fitted in yo-yo half 12 and central hub 20, with the only other contact to central shaft 14 being bearing-pulley 44 which resides on the shaft and is in a slip relationship therewith.

As is obvious, and has been earlier explained, the purpose of the invention is to present a method by which a yo-yo will spin for extended periods of time, at the end of its string, by reducing the friction between the string and the central shaft. Here the invention reduces that friction by having the string attached to an intermediary, namely bearing-pulley 44. Then the bearing-pulley 44 are made of materials which inherently have better slip characteristics then does a string and central axle. When the yo-yo is operated, the operator throws it down with a downward motion of the arm followed by a downward flick of the hand which starts the yo-yo rotating. The yo-yo unwinds upon the string and as the yo-yo rotates, the centrifugal force urges the weighted upper and lower clutch members of the clutch mechanism against compression springs 22 and 24, freeing the bearing-pulley 44 which theretofore was held stationary relative to the yo-yo through frictional surface 46 and upper and lower clutch members 16 and 18. At this point, the bearing-pulley 44 is no longer fixed to the yo-yo half and the bearing becomes free running. The yo-yo will continue to drop to the ground, if thrown in that direction, aided by gravity, and due to the radiating spokes on yo-yo half 12 (as well as their counterparts 47 on yo-yo half 10) which have a tendency to grip the string so as to have sufficient friction between the string and the yo-yo, the yo-yo will increase its rotational rate as it falls. When the yo-yo reaches the end of the string, it will continue to spin unaided until one of two events happen. First of all, the yo-yo may be retracted by a flick upward of the hand. While it is not completely understood by the inventor why the inventive yo-yo retracts voluntarily when urged by the flick of the operator's hand, it is believed that by quickly flicking the hand and thus urging the yo-yo towards the operator, the clutch mechanism is momentarily engaged so that the bearing-pulley is firmly held and begins to rotate with the yo-yo and thus gathers string into the pulley section and retracts to the operator's hand. It is also believed that the starburst design upon the inside opposite faces of the yo-yo halves, may enhance the return, although tests made without the starburst design still result in the yo-yo returning to the operator's hand when commanded.

The other method by which the yo-yo will return to the operator is that after the yo-yos rotational rate has slowed to the point where the centrifugal force no longer overcomes compression springs 22 and 24, springs will urge the upper and lower clutch members 16 and 18 against the frictional surface 46 of bearing-pulley 44, and once accomplished, proceed to wind the yo-yo up into the hand of the operator automatically.

Now it has been determined, that to avoid slipping problems between the string and the central axle portion of bearing-pulley 44, it is suggested, depending upon the materials used both for the string and the bearing-pulley 44, to double or triple loop the string around the central portion of bearing-pulley 44.

Continuing on now, FIG. 3 shows the yo-yo left half 12 in a cross-sectional view, circular recession 42 about the central opening, and the slight outward protrusions representing two of the radiating spokes 40 immediately outside circular recession 42. For operator hand comfort, the outside of the yo-yo half has been half-rounded. On the far outside portion of the yo-yo half 12 is an annular groove to receive decoration as desired, or a decorative lid may be placed there. As previously stated, the central opening through the disk shaped yo-yo half 12 is so sized to accept the central shaft 14 in a press-fit orientation.

Moving on, bearing-pulley 44 is detailed in cross-section shown comprising the annular groove formed in the pulley portion to receive yo-yo string 45, shown here with two complete turns within the annular groove. Next to the pulley portion of the bearing-pulley 44 is the mass of material comprising the solid disk portion upon which peripherial surface is the rubberized frictional surface material 46. Unlike the central opening through yo-yo left half 12, the central opening through bearing-pulley 44 hub is slightly greater than the diameter of the central shaft 14 in order that bearing-pulley 44 will rotate with a minimum friction when the upper and lower clutch members are not engaging the frictional surface 44.

Continuing to FIG. 5, a cross-sectional view of the inventive yo-yo right half 10 is detailed. Proceeding from left to right, the counterpart of radiating spokes 40 on left half 12 are shown by number 47, the radiating spokes comprising slightly raised linear protrusions upon the inside face of right yo-yo half 10. Proceeding inward then, centrally located circular depression 48 is observed for accomodation of the right hand side of the pulley portion of the bearing-pulley 44. Depression 48 in turn continues into opening 50. Opening 50 permits the mass of material attached to bearing-pulley 44 upon which frictional surface 46 resides to penetrate further into yo-yo half 10. Directly over frictional surface 46 (when installed) are the upper clutch mechanism 16 and its compression spring 22. Similarily, lower clutch mechanism 18 and its compression spring 24 are located in the lower section of yo-yo half 10. The clutch members both upper and lower, are shown in a position not to engage frictional surface 46, but reflect the position of the clutch members when the yo-yo is spinning at a speed sufficiently that the clutch members have pulled away from engaging frictional surface 46. Continuing, hub 20 is shown, here suspended in the drawing because with the sectional view taken does not show the connective members. However, connective member 36 is not shown in dotted form, not for diagramic accuracy, but to indicate that the hub 20 is indeed attached to yo-yo half 10 at a point behind the surface of the drawing. Here again, the central opening through hub 20 is so sized to engage central shaft 14 in a press-fit relationship.

Again, as in the yo-yo left half 12, decoration and/or a lid may be placed in the large circular depression formed in the outside of the yo-yo right half 10.

While the invention extends to the general principle of having the yo-yo string attached to a bearing and then the yo-yo central shaft rotating within the relatively stationary bearing in order to enhance spinning time, it is appreciated that other modifications can be made so that a similar responding yo-yo can be constructed utilizing similar principles illustrated in the preferred embodiment.

For example, FIG. 6 details in a perspective view a clutch mechanism formed from the concept of hub 20 and connective members 34 and 36 by a single cross member 60 wherein rounded nose weighted pistons, spring loaded, are urged towards the frictional surface 46 to engage same when the yo-yo is either stopped or rotating at a very slow rate. The principle utilized, as in the preferred embodiment, is the same, i.e., centrifugal force generated by the rotating yo-yo urges the nosed weighted pistons against their compression spring and away from the frictional surface 46.

Referring now to FIG. 6, single cross member 60 details an opening in the central portion to receive the central shaft 14 in a press-fit holding relationship. On opposite ends of cross-member 60, the ends of which are adopted to fit within the large depression formed on the outside of yo-yo right half 10, are means with which to slide the weighted clutch members, pistons 62 and 64, towards the frictional surface 46 hereinafter described. Urging both weighted clutch members 62 and 64 towards the center are compression springs 66 and 68 which, when the yo-yo is assembled, are held in place in a slideway and against the interior annular wall formed in yo-yo right half member 10.

The alternate embodiment is better detailed in FIG. 7 where a cross-sectional view is shown of cross member 60 in alignment with the portions of the yo-yo which it comes into contact. Parts of the yo-yo already described are repeated here for ease of recognition. Yo-yo half 10 still contains the opening 50 and the circular depression 48 centrally formed. Through the opening 50 will be situated bearing-pulley 44 shown with its frictional surface 46 in position to receive the action of the weighted clutch members 62 and 64. The balance of the yo-yo originally shown in FIGS. 1, 2, and 3, are not repeated.

As can be seen by the alternate embodiment, the same principle works to utilize centrifugal force in the rotating yo-yo to urge back the weighted clutch members to prolong the spinning time. Here as before, bearing-pulley 44 spins upon the central shaft 14 (not shown).

While a preferred embodiment and one alternate embodiment has been shown and described in detail, there are obviously many other embodiments and variations and configurations which may be made by a person skilled in the art without departing from the spirit, scope, or principle of this invention. Therefore, this invention is not to be limited except in accordance with the scope of the appended claims.

I claim:

1. A superior performance yo-yo exhibiting an increased spinning time for performing tricks comprising:

a first and second spaced apart opposed complimentary circular disks;

an axle attached at opposite ends to said spaced apart disks, said axle transverse to said disks at their centers;

a bearing means situated around said axle between said disks;

a clutch mechanism operably attached to said second of said spaced apart disks, said clutch mechanism adapted to act upon said bearing means; and a string attached to said bearing means whereby when the yo-yo is thrown, it tends to spin about the bearing at the end of the string.

2. The superior performance yo-yo as defined in claim 1 where said bearing means situated around said axle defines in part an annular groove formed in the outside of said bearing, said annular groove adapted to receive said yo-yo string.

3. The superior performance yo-yo as defined in claim 2 wherein said bearing means additionally includes a cylindrical surface adapted to be engaged by said clutch mechanism, said cylindrical surface juxtaposed said annular groove.

4. The superior performance yo-yo as defined in claim 3 wherein said clutch mechanism adapted to engage said cylindrical surface includes at least one movable clutch securing member to engage and hold said cylindrical surface, said movable clutch securing member responsive to centrifugal force generated by the spinning yo-yo in a direction away from said cylindrical surface.

5. The superior performance yo-yo as defined in claim 4 wherein said bearing means cylindrical surface defines a frictional surface having characteristics of resistance to slip.

6. The superior performance yo-yo as defined in claim 5 wherein said clutch securing member defines an arm forcibly urged against said frictional surface in opposition to the generated centrifugal force.

7. The superior performance yo-yo as defined in claim 6 wherein said clutch securing member arm defines at least two lever arms urged against said frictional surface, each said lever arms pivotally attached at one end to said second disk.

8. The superior performance yo-yo as defined in claim 7 wherein each said lever arms have weights attached at a second end opposite said pivotal point.

9. The superior performance yo-yo as defined in claim 8 wherein said clutch mechanism forcibly urging said lever arms against said frictional surface includes compression springs interposed between said lever arms and said second disk whereby the centrifugal force throws back the clutch lever arms away from the frictional surface allowing the yo-yo to freely spin, the operator then voluntarily returning the yo-yo to his hand by flicking the string causing the clutch lever arms to engage and grip the frictional surface, or the yo-yo automatically returns to the operator's hand when the compression springs overcome the generated centrifugal force and cause the clutch lever arms to engage and grip the frictional surface.

10. The superior performance yo-yo as defined in claim 5 wherein said clutch securing member defines a weighted piston forcibly urged against said frictional surface in opposition to the generated centrifugal force.

11. The superior performance yo-yo as defined in claim 10 wherein said clutch securing member defines at least two weighted pistons spring loaded against said frictional surface, each said weighted pistons and coacting compression springs located in cylinders, said cylinders operably attached to said second disk whereby the centrifugal force throws back the weighted pistons away from the frictional surface allowing the yo-yo to spin freely, the operator then voluntarily returning the yo-yo to his hand by flicking the string causing the weighted pistons to engage and grip the frictional surface, or the yo-yo automatically returns to the operator's hand when the compression springs overcomes the generated centrifugal force and cause the weighted pistons to engage and grip the frictional surface.

12. The superior performance yo-yo as defined in claim 5 wherein said first and second spaced apart opposed complimentary disks include circular depressions formed about the connecting axle upon the inside face of each circular disk, said circular depressions adapted to receive therein opposite sides of the bearing means annular groove, said second disk additionally including a second circular depression internal to said first circular depression, said second circular depression adapted to accomodate the bearing means frictional surface, and both said first and second disks include upon their inside face, a plurality of radially directed upraised linear protrusions.

* * * * *